US012637969B2

(12) United States Patent
Vernekar

(10) Patent No.: US 12,637,969 B2
(45) Date of Patent: May 26, 2026

(54) SYSTEMS AND METHODS FOR DETECTING DEGRADATION OF CATALYST MEMBERS OF AN AFTERTREATMENT SYSTEM

(71) Applicant: Cummins Emission Solutions Inc., Columbus, IN (US)

(72) Inventor: Chandrashekar V. Vernekar, Hubli (IN)

(73) Assignee: Cummins Emission Solutions Inc., Columbus, IN (US)

( * ) Notice: Subject to any disclaimer, the term of this patent is extended or adjusted under 35 U.S.C. 154(b) by 0 days.

(21) Appl. No.: 19/171,727

(22) Filed: Apr. 7, 2025

(65) Prior Publication Data

US 2025/0314189 A1 Oct. 9, 2025

(30) Foreign Application Priority Data

Apr. 8, 2024 (IN) ..... 202441028732

(51) Int. Cl.
*F01N 3/20* (2006.01)
*F01N 11/00* (2006.01)

(52) U.S. Cl.
CPC ..... *F01N 3/208* (2013.01); *F01N 11/002* (2013.01); *F01N 2560/026* (2013.01)

(58) Field of Classification Search
CPC .. F01N 3/208; F01N 11/002; F01N 2560/026; F01N 3/2066; F01N 2550/02; F01N 2610/02; F01N 11/00; F01N 13/009; F01N 13/0093; Y02T 10/12
See application file for complete search history.

(56) References Cited

U.S. PATENT DOCUMENTS

| | | | | |
|---|---|---|---|---|
| 6,925,796 | B2 | 8/2005 | Nieuwstadt et al. | |
| 8,091,416 | B2 * | 1/2012 | Wang | F01N 3/2066 73/114.75 |
| 9,638,122 | B2 | 5/2017 | Smith et al. | |
| 9,909,517 | B2 * | 3/2018 | Kothandaraman | F02D 41/2422 |
| 11,372,632 | B2 * | 6/2022 | Hadi Salim | G06F 8/447 |
| 11,732,632 | B1 | 8/2023 | Ethington et al. | |
| 2017/0130637 | A1 | 5/2017 | Franz et al. | |
| 2019/0093535 | A1 * | 3/2019 | Devarakonda | G05B 13/041 |
| 2021/0033041 | A1 | 2/2021 | Sommansson et al. | |
| 2024/0209762 | A1 * | 6/2024 | Sundararajan | F01N 3/2066 |

* cited by examiner

*Primary Examiner* — Hoang M Nguyen
(74) *Attorney, Agent, or Firm* — Foley & Lardner LLP

(57) ABSTRACT

A non-transitory computer-readable media having computer-readable instructions stored thereon that, when executed by at least one controller, cause the at least one controller to cause a first doser to cease dosing a first reductant portion of a reductant to a first exhaust portion of exhaust upstream of a first catalyst member disposed in a first leg of a selective catalytic reduction (SCR) system. The instructions can cause the at least one controller to cause a second doser to dose a second reductant portion of the reductant to a second exhaust portion of the exhaust upstream of a second catalyst member disposed in a second leg of the SCR system. The instructions can cause the at least one controller to determine a first conversion efficiency of the first leg while the first doser is not dosing the first reductant portion and the second doser is dosing the second reductant portion.

20 Claims, 4 Drawing Sheets

SYSTEMS AND METHODS FOR DETECTING DEGRADATION OF CATALYST MEMBERS OF AN AFTERTREATMENT SYSTEM

CROSS-REFERENCE TO RELATED APPLICATION

The present application claims priority to and the benefit of Indian Patent Application number 202441028732, filed Apr. 8, 2024, the entire disclosure of which is hereby incorporated by reference.

TECHNICAL FIELD

The present disclosure relates generally to aftertreatment systems for use with internal combustion (IC) engines. Specifically, this disclosure relates to aftertreatment systems with at least two dosers and at least two selective catalytic reduction systems.

BACKGROUND

Internal combustion engines, such as diesel engines, emit exhaust that includes nitrogen oxide ($NO_x$) compounds. It is desirable to reduce $NO_x$ emissions, for example, to comply with environmental regulations. To reduce $NO_x$ emissions, a reductant may be dosed into the exhaust by a dosing system in an aftertreatment system. The reductant cooperates with a catalyst of a catalyst member to facilitate conversion of a portion of the exhaust into non-$NO_x$ emissions, such as nitrogen ($N_2$), carbon dioxide ($CO_2$), and water ($H_2O$), thereby reducing $NO_x$ emissions. In some applications, compounds of the exhaust can also be filtered or removed by one or more catalyst members (e.g., a diesel oxidation catalyst (DOC) member, a selective catalytic reduction (SCR) catalyst member, diesel particulate filter (DPF) member, an ammonia oxidation ($AMO_x$) catalyst member, etc.) located in an aftertreatment system. The aftertreatment system can have two dosers and two catalyst members. Each of the catalyst members can be downstream of one of the dosers.

SUMMARY

Embodiments described herein relate generally to systems and methods for detecting catalyst degradation of aftertreatment systems including multiple legs, and in particular, to aftertreatment systems that include a controller configured to determine the catalytic conversion efficiency of each of the legs. The conversion efficiency can be determined using fewer NO sensors than conventional aftertreatment systems.

One aspect of the present disclosure is directed to a non-transitory computer-readable media having computer-readable instructions stored thereon that, when executed by at least one controller, cause the at least one controller to cause a first doser to cease dosing a first reductant portion of a reductant to a first exhaust portion of exhaust upstream of a first catalyst member disposed in a first leg of a selective catalytic reduction (SCR) system. The instructions can cause the at least one controller to cause a second doser to dose a second reductant portion of the reductant to a second exhaust portion of the exhaust upstream of a second catalyst member disposed in a second leg of the SCR system. The instructions can cause the at least one controller to determine a first conversion efficiency of the first leg while the first doser is not dosing the first reductant portion and the second doser is dosing the second reductant portion. The instructions can cause the at least one controller to cause the second doser to cease dosing the second reductant portion to the second exhaust portion. The instructions can cause the at least one controller to cause the first doser to dose the first reductant portion to the first exhaust portion. The instructions can cause the at least one controller to determine a second conversion efficiency of the second leg while the first doser is dosing the first reductant portion and the second doser is not dosing the second reductant portion. The instructions can cause the at least one controller to compare the first conversion efficiency to a first conversion efficiency threshold. The instructions can cause the at least one controller to compare the second conversion efficiency to a second conversion efficiency threshold. The instructions can cause the at least one controller to provide an indication responsive to a determination that at least one of the first conversion efficiency is less than the first conversion efficiency threshold or the second conversion efficiency is less than the second conversion efficiency threshold. Another aspect of the present disclosure is directed to a method. The method can include causing, by at least one controller, a first doser to cease dosing a first reductant portion of a reductant to a first exhaust portion of exhaust upstream of a first catalyst member disposed in a first leg of the SCR system. The method can include causing, by the at least one controller, a second doser to dose a second reductant portion of the reductant to a second exhaust portion of the exhaust upstream of a second catalyst member disposed in a second leg of the SCR system. The method can include determining, by the at least one controller, a first conversion efficiency of the first leg while the first doser is not dosing the first reductant portion and the second doser is dosing the second reductant portion. The method can include causing, by the at least one controller, the second doser to cease dosing the second reductant portion to the second exhaust portion. The method can include causing, by the at least one controller, the first doser to dose the first reductant portion to the first exhaust portion. The method can include determining, by the at least one controller, a second conversion efficiency of the second leg while the first doser is dosing the first reductant portion and the second doser is not dosing the second reductant portion. The method can include comparing, by the at least one controller, the first conversion efficiency to a first conversion efficiency threshold. The method can include comparing, by the at least one controller, the second conversion efficiency to a second conversion efficiency threshold. The method can include providing, by the at least one controller, an indication responsive to a determination that at least one of the first conversion efficiency is less than the first conversion efficiency threshold or the second conversion efficiency is less than the second conversion efficiency threshold.

Those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

BRIEF DESCRIPTION OF THE DRAWINGS

A clear conception of the advantages and features constituting the present disclosure, and of the construction and operation of typical mechanisms provided with the present disclosure, will become more readily apparent by referring to the exemplary, and therefore non-limiting, embodiments illustrated in the drawings accompanying and forming a part of this specification, wherein like reference numerals designate the same elements in the several views, and in which.

Figure 1:
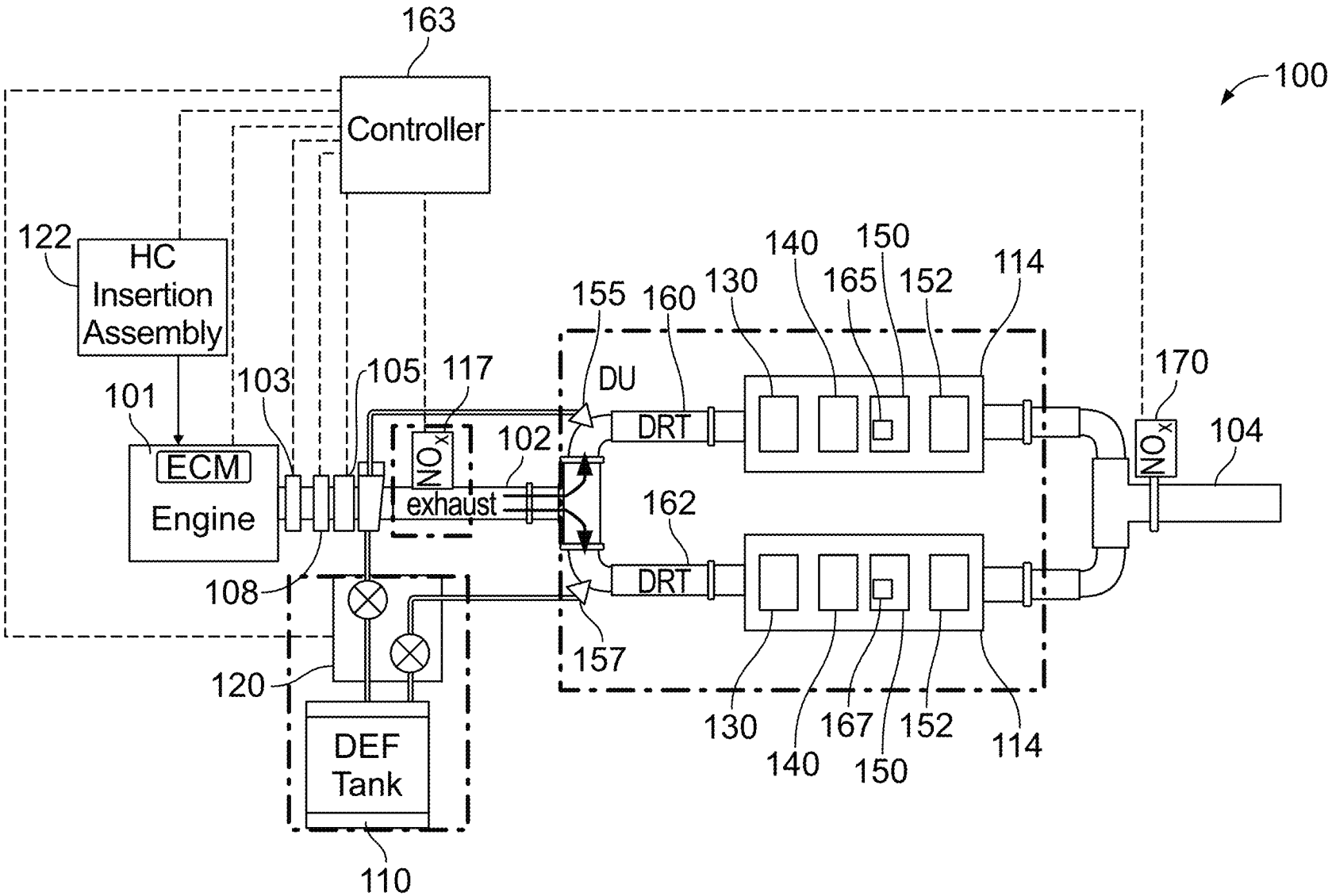
FIG. 1 is a schematic diagram of an aftertreatment system, according to an example embodiment.

The foregoing and other features of the present disclosure will become apparent from the following description and appended claims, taken in conjunction with the accompanying drawings. Understanding that these drawings depict only several embodiments in accordance with the disclosure and are therefore, not to be considered limiting of its scope, the disclosure will be described with additional specificity and detail through use of the accompanying drawings.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

I. Overview

Some aftertreatment systems include two or more legs, each of which includes various components of the aftertreatment system. Exhaust gas generated by the engine is divided into portions that flow into each leg of the aftertreatment system. Such aftertreatment systems have one or more catalyst members in each leg for reduction of $NO_x$. To detect degradation of the one or more catalyst members, $NO_x$ sensors can be located in each leg of the aftertreatment system. While this allows for detection of degradation of the catalyst members in the legs, such aftertreatment systems may increase hardware requirements. For example, such aftertreatment system can include excess $NO_x$ sensors.

In contrast, aftertreatment systems described herein achieve detection of degradation of catalyst members in the legs of the aftertreatment system by using a single $NO_x$ sensor downstream each of the legs. This eliminates use of $NO_x$ sensors in each leg. Thus, the catalytic conversion efficiency of each of the legs and degradation of the catalyst members can be determined using fewer $NO_x$ sensors than conventional aftertreatment systems. This may decrease a cost associated with the aftertreatment systems described herein compared to conventional aftertreatment systems.

II. Overview of Exhaust Gas Aftertreatment Systems

FIG. 1 depicts an aftertreatment system 100. The aftertreatment system 100 is configured to receive exhaust gas (e.g., diesel exhaust gas, etc.) from an engine 101 (e.g., motor, etc.) and treat constituents (e.g., $NO_x$, CO, $CO_2$, etc.) of the exhaust gas. The engine 101 may be, for example, a diesel engine, a gasoline engine, a natural gas engine, a dual fuel engine, a biodiesel engine, an E-85 engine, or any other suitable engine. The engine 101 combusts fuel and generates an exhaust gas that includes $NO_x$, CO, $CO_2$, and other constituents. The engine 101 may include other components, for example, a transmission, fuel insertion assemblies, a generator or alternator to convert the mechanical power produced by the engine into electrical power.

The aftertreatment system 100 includes a housing 114 (e.g., casing, cover, container, shell, etc.) in which various aftertreatment components of the aftertreatment system 100 are disposed. The housing 114 may be formed from a rigid, heat-resistant and corrosion-resistant material, for example stainless steel, iron, aluminum, metals, ceramics, or any other suitable material. The housing 114 may have any suitable cross-section, for example, circular, square, rectangular, oval, elliptical, polygonal, or any other suitable shape.

The aftertreatment system 100 includes an inlet conduit 102 (e.g., channel, duct, pipe, tube, chute, etc.) that is fluidly coupled to an inlet of the housing 114 and structured to receive exhaust gas from the engine 101 and communicate the exhaust gas to an internal volume defined by the housing 114. The inlet conduit 102 can fluidly couple the housing 114 with the engine 101.

The aftertreatment system 100 includes at least one controller 163 (e.g., control circuit, driver, etc.) electrically coupled to components of the aftertreatment system 100. The at least one controller 163 can be operably coupled to the engine 101. The aftertreatment system 100 can include non-transitory computer-readable media. The non-transitory computer-readable media can be executed by the at least one controller 163.

The aftertreatment system 100 includes an outlet conduit 104 (e.g., channel, duct, pipe, tube, chute, etc.). The outlet conduit 104 may be coupled to an outlet of the housing 114 and structured to expel treated exhaust gas into the environment (e.g., treated to remove particulate matter and/or reduce constituents of the exhaust gas such as $NO_x$ gases, CO, unburnt hydrocarbons, etc.).

The aftertreatment system 100 may include a heater 108 (e.g., ceramic heater, electric heater, etc.) that is disposed upstream of the other aftertreatment components, for example, in the inlet conduit 102 proximate to an engine exhaust manifold (e.g., at an outlet of a turbo coupled to the engine 101). The heater 108 may be an electrical heater, which may have an input voltage in a range of 36 to 52 Volts (V) and a heater power in a range of 10 to 100 kilowatts (kW) (i.e., the electrical power consumed by the heater 108 to generate heat). In some embodiments, the heater 108 is a 48 V, 10 KW electric heater. The heater 108 is configured to selectively heat the exhaust gas entering the aftertreatment system 100.

The aftertreatment system 100 may include a first temperature sensor 103 (e.g., detector, indicator, etc.). The first temperature sensor 103 may be positioned in the inlet conduit 102 upstream of the heater 108. The first temperature sensor 103 is configured to measure an upstream exhaust gas temperature of the exhaust gas upstream of the heater 108. The first temperature sensor 103 can provide a signal to the at least one controller 163. The signal provided to the at least one controller 163 is associated with a temperature of the exhaust gas. The at least one controller 163 determines the temperature of the exhaust gas based on the signal.

The aftertreatment system 100 may include a second temperature sensor 105 (e.g., detector, indicator, etc.) is also disposed downstream of the heater 108, for example, proximate to an outlet of the heater 108 and configured to measure a downstream exhaust gas temperature of the exhaust gas downstream of the heater 108. The second temperature sensor 105 can provide a signal to the at least one controller 163. The signal provided to the at least one controller 163 is associated with a temperature of the exhaust gas. The at least one controller 163 determines the temperature of the exhaust gas based on the signal.

In some embodiments, other sensors, for example, pressure sensors, oxygen sensors, and/or any other sensors configured to measure one or more operational parameters of the exhaust gas entering the aftertreatment system 100 may be disposed in the inlet conduit 102. In some embodiments, each of the first temperature sensor 103 and the second temperature sensor 105 may be excluded, and instead, the upstream and downstream exhaust gas temperatures may be determined virtually (e.g., by the at least one controller 163), using equations, algorithms, or look up tables, for example, based on operating parameters of the engine 101 exhaust gas flow rate, heater power consumed, etc.

The aftertreatment system 100 may include an oxidation catalyst 130. The oxidation catalyst 130 is disposed downstream of the heater 108 in the housing 114 and configured to decompose unburnt hydrocarbons and/or CO included in the exhaust gas. In some embodiments, the oxidation catalyst 130 may include a diesel oxidation catalyst. When a temperature of the oxidation catalyst 130 is equal to or above a light-off temperature of the oxidation catalyst 130, the oxidation catalyst 130 catalyzes combustion of the inserted hydrocarbons so as to cause an increase in the temperature of the exhaust gas. The oxidation catalyst 130 may catalyze ignition of the hydrocarbon so as to increase a temperature of the exhaust gas for regenerating the oxidation catalyst 130 and/or regenerating other elements within the housing 114.

The aftertreatment system 100 may include a hydrocarbon insertion assembly 122. The hydrocarbon insertion assembly 122 may be selectively activated to insert hydrocarbons into the oxidation catalyst 130 for heating the exhaust gas. The hydrocarbon insertion assembly 122 can selectively inject hydrocarbons (e.g., fuel) upstream of the oxidation catalyst 130. The hydrocarbon insertion assembly 122 is configured to selectively insert hydrocarbons (e.g., the same fuel that is being consumed by the engine 101) upstream of the oxidation catalyst 130, for example, into the engine 101.

The aftertreatment system 100 includes a first $NO_x$ sensor 117 (e.g., gas sensor, $NO_x$ sensor, $NO_x$ detector, $NO_x$ indicator, etc.). The first $NO_x$ sensor 117 can include an inlet sensor. The first $NO_x$ sensor 117 may be positioned in the inlet conduit 102. The first $NO_x$ sensor 117 can be configured to determine an amount of $NO_x$ gases expelled from the engine 101. The first $NO_x$ sensor 117 can provide a signal to the at least one controller 163. The signal provided to the at least one controller 163 is associated with an amount of $NO_x$. The at least one controller 163 determines the amount of $NO_x$ based on the signal. The first $NO_x$ sensor 117 can be disposed in the housing 114 downstream of the heater 108 and upstream of any aftertreatment component that treats the constituents of the exhaust gas. For example, as shown in FIG. 1, the first $NO_x$ sensor 117 is disposed downstream of the heater 108 and upstream of the oxidation catalyst 130.

The aftertreatment system 100 may include a filter 140 (e.g., mesh, separator, etc.). The filter 140 can be disposed downstream of the oxidation catalyst 130 and upstream of the SCR system 150. The filter 140 can be configured to remove particulate matter (e.g., soot, debris, inorganic particles, etc.) from the exhaust gas. In some embodiments, the filter 140 may include a ceramic filter. In some embodiments, the filter 140 may include a cordierite filter which can, for example, be an asymmetric filter. In yet other embodiments, the filter 140 may be catalyzed. The filter 140 can include a diesel particulate filter.

The aftertreatment system 100 includes a SCR system 150. The SCR system 150 is configured to decompose constituents of an exhaust gas flowing therethrough in the presence of a reductant, as described herein. In some embodiments, the SCR system 150 may include a selective catalytic reduction filter (SCRF). The SCR system 150 includes an SCR catalyst member configured to catalyze decomposition of the $NO_x$ gases into its constituents in the presence of a reductant. Any suitable SCR catalyst member may be used such as, for example, platinum, palladium, rhodium, cerium, iron, manganese, copper, vanadium-based catalyst, any other suitable catalyst, or a combination thereof. The SCR catalyst member may be disposed on a suitable substrate such as, for example, a ceramic (e.g., cordierite) or metallic (e.g., kanthal) monolith core that can, for example, define a honeycomb structure. A washcoat can also be used as a carrier material for the SCR catalyst member. Such washcoat materials may comprise, for example, aluminum oxide, titanium dioxide, silicon dioxide, any other suitable washcoat material, or a combination thereof.

The aftertreatment system 100 can include an ammonia oxidation ($AMO_x$) catalyst member 152. The $AMO_x$ catalyst 152 may be positioned downstream of the SCR system 150 and formulated to decompose any unreacted ammonia that flows past the SCR system 150.

Although FIG. 1 shows only the oxidation catalyst 130, the filter 140, the SCR system 150, and the $AMO_x$ catalyst 152 disposed in the internal volume defined by the housing 114, in other embodiments, a plurality of aftertreatment components may be disposed in the internal volume defined by the housing 114 in addition to, or in place of the oxidation catalyst 130, the filter 140, the SCR system 150, and the $AMO_x$ catalyst 152. Such aftertreatment components may include, for example, a two-way catalyst, mixers, baffle plates, secondary filters (e.g., a secondary partial flow or catalyzed filter) and/or any other suitable aftertreatment component.

The aftertreatment system 100 includes two or more reductant ports (e.g., opening, outlet, etc.). The reductant port may be positioned on a sidewall of the housing 114 and structured to allow insertion of a reductant therethrough into the internal volume defined by the housing 114. The reductant port may be positioned upstream of the SCR system 150 (e.g., to allow reductant to be inserted into the exhaust gas upstream of the SCR system 150) or over the SCR system 150 (e.g., to allow reductant to be inserted directly on the SCR system 150). Mixers, baffles, vanes or other structures may be positioned in the housing 114 upstream of the SCR system 150 (e.g., between the filter 140 and the SCR system 150) so as to facilitate mixing of the reductant with the exhaust gas.

The aftertreatment system 100 includes a reductant storage tank 110 (e.g., container, reservoir, etc.) that is structured to store a reductant. The reductant is formulated to facilitate decomposition of the constituents of the exhaust gas (e.g., $NO_x$ gases included in the exhaust gas). Any suitable reductant may be used. In some embodiments, the exhaust gas comprises a diesel exhaust gas and the reductant comprises a diesel exhaust fluid (DEF). For example, the DEF may comprise urea, an aqueous solution of urea, or any other fluid that comprises ammonia, by-products, or any other diesel exhaust fluid as is known in the arts (e.g., the DEF marketed under the name ADBLUE®). For example, the reductant may comprise an aqueous urea solution having a particular ratio of urea to water. In some embodiments, the reductant can comprise an aqueous urea solution including 32.5% by weight of urea and 67.5% by weight of deionized water, including 40% by weight of urea and 60% by weight of deionized water, or any other suitable ratio of urea to deionized water.

The aftertreatment system 100 includes a reductant insertion assembly 120 that is fluidly coupled to the reductant storage tank 110. The reductant insertion assembly 120 is configured to selectively insert the reductant into the SCR system 150 or upstream thereof, or upstream or into a mixer (not shown) positioned upstream of the SCR system 150. The reductant insertion assembly 120 may comprise various structures to facilitate receipt of the reductant from the reductant storage tank 110 and delivery to the SCR system 150, for example, pumps, valves, screens, filters, etc.

The aftertreatment system 100 includes a doser (e.g., reductant doser, reductant injector) that is fluidly coupled to the reductant insertion assembly 120 and configured to insert the reductant (e.g., a combined flow of reductant and compressed air) into the SCR system 150. In some embodiments, the doser may include a nozzle having a predetermined diameter. In some embodiments, the doser may be positioned in the reductant port and structured to deliver a stream or a jet of the reductant into the internal volume of the housing 114 so as to deliver the reductant to the SCR system 150.

The at least one controller 163 may be operatively coupled to the first temperature sensor 103, the second temperature sensor 105, the first $NO_x$ sensor 117, the heater 108, and in some embodiments, the reductant insertion assembly 120, and/or the hydrocarbon insertion assembly 122. For example, the at least one controller 163 may be configured to receive an upstream exhaust gas temperature signal from the first temperature sensor 103 and receive a downstream exhaust gas temperature signal from the second temperature sensor 105 to determine the upstream exhaust gas temperature and the downstream exhaust gas temperature, respectively. The at least one controller 163 is configured to determine the upstream exhaust gas temperature upstream of the heater 108, for example, based on the exhaust gas temperature signal received from the first temperature sensor 103. The upstream exhaust gas temperature corresponds to the temperature of the exhaust gas entering the aftertreatment system 100. The at least one controller 163 may also be configured to determine the downstream exhaust gas temperature downstream of the heater 108, for example, based on a signal received from the second temperature sensor 105.

The at least one controller 163 may be operably coupled to the engine 101, the first temperature sensor 103, the second temperature sensor 105, the heater 108, the first $NO_x$ sensor 117, the reductant insertion assembly 120, the hydrocarbon insertion assembly 122, and/or various components of the aftertreatment system 100 using any type and any number of wired or wireless connections. For example, a wired connection may include a serial cable, a fiber optic cable, a CAT5 cable, or any other form of wired connection. Wireless connections may include the Internet, Wi-Fi, cellular, radio, Bluetooth, ZigBee, etc. In one embodiment, a controller area network (CAN) bus provides the exchange of signals, information, and/or data. The CAN bus includes any number of wired and wireless connections. In some embodiments, the at least one controller 163 includes various circuitries or modules configured to perform the operations of the at least one controller 163 described herein.

III. Overview of Systems and Methods for Detecting Catalyst Member Degradation Aftertreatment systems with a dual-leg architecture can have catalyst member in each leg for $NO_x$ reduction. The systems and methods of the present disclosure can isolate a leg that has a degraded catalyst member such that the aftertreatment system can be serviced or the degraded catalyst member can be replaced. Issues relating to low $NO_x$ conversion efficiencies can be identified using fewer $NO_x$ sensors than conventional systems.

FIG. 1 further illustrates the aftertreatment system 100. The aftertreatment system 100 includes two or more legs. For example, the aftertreatment system 100 can include a first leg 160 and a second leg 162. The first leg 160 can be fluidly coupled with the inlet conduit 102 and with the outlet conduit 104. Exhaust gas can flow from the inlet conduit 102, through the first leg 160, and to the outlet conduit 104. The second leg 162 can be fluidly coupled with the inlet conduit 102 and with the outlet conduit 104. Exhaust gas can flow from the inlet conduit 102, through the second leg 162, and to the outlet conduit 104. Exhaust gas from the first leg 160 and from the second leg 162 can flow into the outlet conduit 104. Exhaust gas from the first leg 160 and from the second leg 162 can mix before entering the outlet conduit 104. The first leg 160 and the second leg 162 can be free of any $NO_x$ sensors. According to one embodiment, there are no $NO_x$ sensors disposed on or in the first leg 160 and the second leg 162. Any $NO_x$ sensors in the aftertreatment system 100 can measure exhaust gas that is not in the first leg 160 or the second leg 162. For example, any $NO_x$ sensors in the aftertreatment system 100 can measure exhaust gas in the outlet conduit 104. The first leg 160 and the second leg 162 can be coupled with the outlet conduit 104.

The aftertreatment system 100 can include two or more catalyst members. The two or more catalyst members can include an SCR catalyst member (e.g., a vanadia-based SCR catalyst, ammonia oxidation catalyst). The two or more catalyst members can include a first catalyst member 165 and a second catalyst member 167. The first catalyst member 165 can be disposed in the first leg 160 of the SCR system 150. The first catalyst member 165 can be disposed upstream of the outlet conduit 104. The second catalyst member 167 can be disposed in the second leg 162 of the SCR system 150. The second catalyst member 167 can be disposed upstream of the outlet conduit 104.

The aftertreatment system 100 includes two or more dosers. The two or more doser include a first doser 155 and a second doser 157. The first doser 155 can be disposed upstream of the first catalyst member 165. The first doser 155 can be disposed downstream of the inlet conduit 102. The first doser 155 can be disposed upstream of the outlet conduit 104. The second doser 157 can be disposed upstream of the second catalyst member 167. The second doser 157 can be disposed downstream of the inlet conduit 102. The second doser 157 can be disposed upstream of the outlet conduit 104.

The aftertreatment system 100 includes the first $NO_x$ sensor 117. The first $NO_x$ sensor 117 can be disposed in the inlet conduit 102. The first $NO_x$ sensor 117 can be disposed upstream of the first doser 155. The first $NO_x$ sensor 117 can be disposed upstream of the second doser 157. The at least one controller 163 can receive a first signal from the first $NO_x$ sensor 117. The at least one controller 163 can determine a first $NO_x$ value based on the first signal. The first $NO_x$ sensor 117 can measure the $NO_x$ concentration of the exhaust gas upstream of the first doser 155. The first $NO_x$ sensor 117 can measure the $NO_x$ concentration of the exhaust gas upstream of the second doser 157. The first $NO_x$ sensor 117 can be disposed upstream of the first leg 160. The first $NO_x$ sensor 117 can be disposed upstream of the second leg 162.

The aftertreatment system 100 includes a second $NO_x$ sensor 170 (e.g., gas sensor, $NO_x$ sensor, $NO_x$ detector, $NO_x$ indicator, etc.). The second $NO_x$ sensor 170 can include an outlet sensor. The second $NO_x$ sensor 170 may be positioned in the outlet conduit 104. The second $NO_x$ sensor 170 can be configured to determine an amount of $NO_x$ gases expelled into the environment after passing through the SCR system 150. The second $NO_x$ sensor 170 can provide a signal to the at least one controller 163. The signal provided to the at least one controller 163 is associated with an amount of $NO_x$. The at least one controller 163 determines the amount of $NO_x$ based on the signal.

The second $NO_x$ sensor 170 can be disposed in the outlet conduit 104. The second $NO_x$ sensor 170 can be disposed downstream of the first leg 160. The second $NO_x$ sensor 170 can be disposed downstream of the second leg 162. The at least one controller 163 can receive a second signal from the second $NO_x$ sensor 170. The at least one controller 163 can determine a second $NO_x$ value based on the second signal. The at least one controller 163 can provide the indication that at least one of the first conversion efficiency is less than the first conversion efficiency threshold or the second conversion efficiency is less than the second conversion efficiency threshold based on the first $NO_x$ value and the second $NO_x$ value. The second $NO_x$ sensor 170 can measure the $NO_x$ concentration of the exhaust gas downstream of the first leg 160. The second $NO_x$ sensor 170 can measure the $NO_x$ concentration of the exhaust gas downstream of the second leg 162. The second $NO_x$ sensor 170 can measure the $NO_x$ concentration of the exhaust gas in the outlet conduit 104.

The at least one controller 163 can determine the overall conversion efficiency based on the first $NO_x$ value and the second $NO_x$ value. For example, the at least one controller 163 can, responsive to satisfaction of one or more enabling conditions, determine the overall conversion efficiency based on the first $NO_x$ value and the second $NO_x$ value. The enabling conditions can include whether a temperature of the SCR system 150 is greater than a temperature threshold. The enabling conditions can include whether a flow rate of the SCR system 150 is greater than a flow rate threshold. The enabling conditions can include whether a urea concentration of the SCR system 150 is greater than a urea concentration threshold. The overall conversion efficiency for a healthy catalyst (e.g., undegraded catalyst) can be in a range of 95% to 98%.

The at least one controller 163 can cause the aftertreatment system 100 to operate in a regeneration mode. For example, the at least one controller 163 can cause the aftertreatment system 100 to operate in a regeneration mode associated with regeneration of the first catalyst member 165 and the second catalyst member 167 responsive to determining that the overall conversion efficiency is less than the overall conversion efficiency threshold. The regeneration mode can include clearing out deposits in the first catalyst member 165. The regeneration mode can include clearing out deposits in the second catalyst member 167. Regeneration can involve heating the exhaust gas so that deposits are combusted. The regeneration can be performed by the heater and/or by combustion of a hydrocarbon. The hydrocarbon can be provided by the engine 101 (e.g., by post-combustion injection) and/or a hydrocarbon injector coupled to an exhaust conduit. Insertion of the hydrocarbons may heat the exhaust gas to a sufficient temperature to regenerate the filter 140 by burning off particulate matter that may have accumulated on the filter 140, and/or regenerate the SCR system 150 by evaporating reductant deposits deposited on the SCR system 150 or internal surfaces of the aftertreatment system 100.

The at least one controller 163 can determine that the first leg 160 is underperforming responsive to the determination that the first conversion efficiency is less than the first conversion efficiency threshold. The at least one controller 163 can determine that the second leg 162 is underperforming responsive to the determination that the second conversion efficiency is less than the second conversion efficiency threshold.

Figure 2:
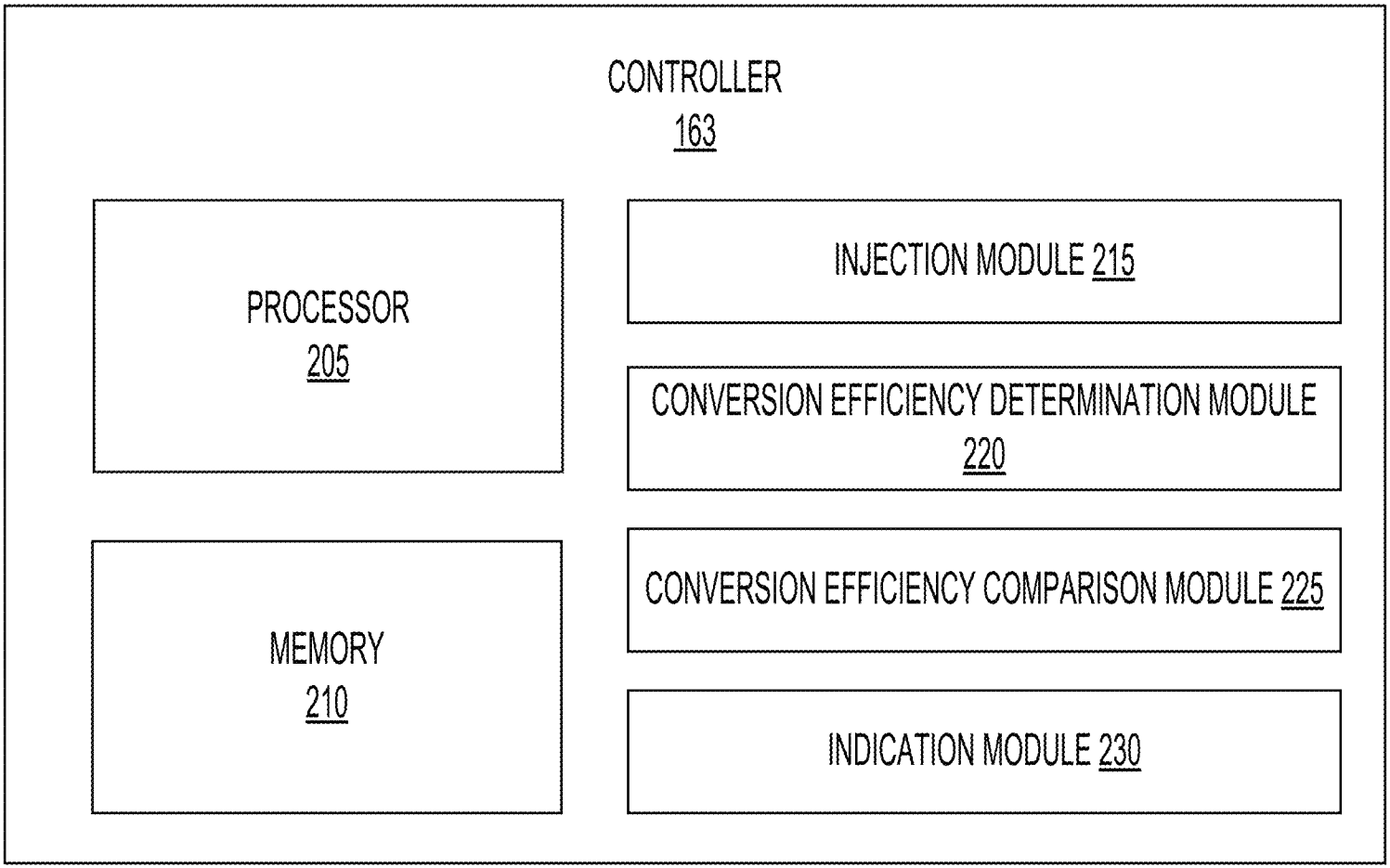
FIG. 2 is a block diagram of a controller of the aftertreatment system of FIG. 1, according to an example embodiment.

FIG. 2 is a block diagram of the at least one controller 163. The at least one controller 163 may be configured to provide an indication that at least one of a first conversion efficiency is less than a first conversion efficiency threshold or a second conversion efficiency is less than a second conversion efficiency threshold. The at least one controller 163 can determine that a first leg 160 and/or second leg 162 of the SCR system 150 is underperforming. For example, if the first leg 160 of the SCR system 150 is underperforming, this can indicate that the one or more catalyst members in the first leg 160 are degraded. If the second leg 162 of the SCR system 150 is underperforming, this can indicate that the one or more catalyst members in the second leg 162 are degraded.

A non-transitory computer-readable media can include computer-readable instructions stored thereon that, when executed by at least one controller 163, cause the at least one controller 163 to cause the first doser 155 to cease dosing a first reductant portion of a reductant to a first exhaust portion of exhaust upstream of the first catalyst member 165 disposed in the first leg 160 of the SCR system 150. The instructions can cause the at least one controller 163 to cause the second doser 157 to dose a second reductant portion of the reductant to a second exhaust portion of the exhaust upstream of the second catalyst member 167 disposed in the second leg 162 of the SCR system 150.

The instructions can cause the at least one controller 163 to determine a first conversion efficiency of the first leg 160 while the first doser 155 is not dosing the first reductant portion and the second doser 157 is dosing the second reductant portion. The instructions can cause the at least one controller 163 to cause the second doser 157 to cease dosing the second reductant portion to the second exhaust portion. The instructions can cause the at least one controller 163 to cause the first doser 155 to dose the first reductant portion to the first exhaust portion. The instructions can cause the at least one controller 163 to determine a second conversion efficiency of the second leg 162 while the first doser 155 is dosing the first reductant portion and the second doser 157 is not dosing the second reductant portion.

The instructions can cause the at least one controller 163 to compare the first conversion efficiency to a first conversion efficiency threshold. The instructions can cause the at least one controller 163 to compare the second conversion efficiency to a second conversion efficiency threshold. The instructions can cause the at least one controller 163 to provide an indication responsive to a determination that at least one of the first conversion efficiency is less than the first conversion efficiency threshold or the second conversion efficiency is less than the second conversion efficiency threshold. The instructions can cause the at least one controller 163 to trigger a fault code responsive to the determination that at least one of the first conversion efficiency is less than the first conversion efficiency threshold or the second conversion efficiency is less than the second conversion efficiency threshold. The fault code can indicate that at least one of the first catalyst member 165 or the second catalyst member 167 is degraded (e.g., unhealthy).

The instructions can cause the at least one controller 163 to, responsive to satisfaction of one or more enabling conditions, determine an overall conversion efficiency based on a first $NO_x$ value obtained from the first $NO_x$ sensor 117 disposed upstream of the first doser 155 and the second doser 157, and a second $NO_x$ value obtained from the second $NO_x$ sensor 170 disposed downstream of the first leg 160 and the second leg 162. The instructions can cause the at least one controller 163 to determine the first conversion efficiency based on a third $NO_x$ value obtained from the first $NO_x$ sensor 117 and a fourth $NO_x$ value obtained from the second $NO_x$ sensor 170. The instructions can cause the at least one controller 163 to determine the second conversion efficiency based on a fifth $NO_x$ value obtained from the first $NO_x$ sensor 117 and a sixth $NO_x$ value obtained from the second $NO_x$ sensor 170.

The instructions can cause the at least one controller 163 to compare the overall conversion efficiency to an overall conversion efficiency threshold. The instructions can cause the at least one controller 163 to cause an engine system to operate in a regeneration mode associated with regeneration of the first catalyst member 165 and the second catalyst member 167 responsive to determining that the overall conversion efficiency is less than the overall conversion efficiency threshold. The overall conversion efficiency threshold can be in a range of 80% to 90%. For example, the overall conversion efficiency threshold can be 85%. The overall conversion efficiency threshold can be less than or equal to the conversion efficiency for a healthy catalyst.

The instructions can cause the at least one controller 163 to determine the overall conversion efficiency responsive to determining that a temperature of the SCR system 150 is greater than a temperature threshold. The instructions can cause the at least one controller 163 to determine the overall conversion efficiency responsive to determining that a flow rate (e.g., exhaust gas flow rate) of the SCR system 150 is greater than a flow rate threshold. The instructions can cause the at least one controller 163 to determine the overall conversion efficiency responsive to determining that a urea concentration of the SCR system 150 is greater than a urea concentration threshold.

The instructions can cause the at least one controller 163 to determine that the first leg 160 is underperforming responsive to the determination that the first conversion efficiency is less than the first conversion efficiency threshold. The instructions can cause the at least one controller 163 to determine that the second leg 162 is underperforming responsive to the determination that the second conversion efficiency is less than the second conversion efficiency threshold.

The at least one controller 163 may include a processor 205 configured to execute computer-readable instructions stored in a computer-readable memory 210. The processor 205 may be implemented in hardware, firmware, software, or any combination thereof. The processor 205 may retrieve instruction(s) from the memory 210 for execution. The memory 210 may be any of a variety of memories that may be suitable for use with the at least one controller 163. For example, in some embodiments, the memory 210 may include Static Random Access Memory (SRAM), Dynamic Random Access Memory (DRAM), Magnetoresistive Random Access Memory (MRAM), Phase Control Memory (PCM), Resistive Random Access Memory (ReRAM), 3D XPoint memory, ferroelectric random-access memory (FeRAM), flash memory, hard disk drive memory, floppy disk memory, magnetic tape memory, optical disk memory, and/or other types of volatile, non-volatile, and semi-volatile memories that may be considered suitable.

The at least one controller 163 may also include an injection module 215, a conversion efficiency determination module 220, a conversion efficiency comparison module 225, and an indication module 230. Although the injection module 215, the conversion efficiency determination module 220, the conversion efficiency comparison module 225, and the indication module 230 are shown as separate components of the at least one controller 163, in some embodiments, at least some of those modules may be integrated together and the integrated module may perform the functions of the individual modules that have been integrated. Further, although not shown, in some embodiments, one or more of the injection module 215, the conversion efficiency determination module 220, the conversion efficiency comparison module 225, and the indication module 230 may have respective processing unit(s) and memory unit(s) to perform their respective functions, as described herein. In other embodiments, one or more of the injection module 215, the conversion efficiency determination module 220, the conversion efficiency comparison module 225, and the indication module 230 may use the processor 205 and the memory 210.

The injection module 215 is configured to control dosing of reductant into the aftertreatment system 100. The injection module 215 can communicate with the first doser 155 or second doser 157 to cause the first doser 155 or the second doser 157 to dose reductant. The injection module 215 can control dosing of a reductant to an exhaust upstream of one or more catalyst members disposed in the SCR system 150. For example, the injection module 215 can cause the first doser 155 to cease dosing the first reductant portion of the reductant to the first exhaust portion of exhaust upstream of the first catalyst member 165 disposed in the first leg 160 of the SCR system 150. The injection module 215 can cause the second doser 157 to dose the second reductant portion of the reductant to the second exhaust portion of the exhaust upstream of the second catalyst member 167 disposed in the second leg 162 of the SCR system 150. The second doser 157 can be dosing reductant while the first doser 155 is not dosing reductant. The injection module 215 can cause the second doser 157 to cease dosing the second reductant portion to the second exhaust portion. The injection module 215 can cause the first doser 155 to dose the first reductant portion to the first exhaust portion. The first doser 155 can be dosing reductant while the second doser 157 is not dosing reductant.

The conversion efficiency determination module 220 is configured to determine an overall conversion efficiency. The overall conversion efficiency is the efficiency of the first catalyst member 165 and the second catalyst member 167 at decomposing $NO_x$ gases into its constituents in the presence of reductant. The reductant can flow through the first leg 160 and the second leg 162. The conversion efficiency determination module 220 is configured to determine the overall conversion efficiency based on the first $NO_x$ value obtained from the first $NO_x$ sensor 117 disposed upstream of the first doser 155 and the second doser 157. The conversion efficiency determination module 220 is configured to determine the overall conversion efficiency based the second $NO_x$ value obtained from the second $NO_x$ sensor 170 disposed downstream of the first leg 160 and the second leg 162.

The conversion efficiency determination module 220 is configured to compare the overall conversion efficiency to an overall conversion efficiency threshold and determine whether the overall conversion efficiency is less than the overall conversion efficiency threshold. If the overall conversion efficiency is less than the overall conversion efficiency threshold, this can indicate that the first catalyst member 165 and or the second catalyst member 167 is degraded. The conversion efficiency determination module 220 is configured to determine the overall conversion efficiency responsive to determining that the temperature of the SCR system 150 is greater than the temperature threshold. The conversion efficiency determination module 220 is configured to determine the overall conversion efficiency responsive to determining that the flow rate of the SCR system 150 is greater than the flow rate threshold. The conversion efficiency determination module 220 is configured to determine the overall conversion efficiency responsive to determining that the urea concentration of the SCR system 150 is greater than the urea concentration threshold.

The conversion efficiency determination module 220 is configured to determine the first conversion efficiency of the first leg 160 while the first doser 155 is not dosing the first reductant portion and the second doser 157 is dosing the second reductant portion. The first conversion efficiency can include the efficiency of the first catalyst member 165 at decomposing $NO_x$ gases into its constituents in the presence of the first reductant portion. The conversion efficiency determination module 220 is configured to determine the second conversion efficiency of the second leg 162 while the first doser 155 is dosing the first reductant portion and the second doser 157 is not dosing the second reductant portion. The second conversion efficiency can include the efficiency of the second catalyst member 167 at decomposing $NO_x$ gases into its constituents in the presence of the second reductant portion.

The conversion efficiency determination module 220 is configured to determine the first conversion efficiency based on the third $NO_x$ value obtained from the first $NO_x$ sensor 117 and the fourth $NO_x$ value obtained from the second $NO_x$ sensor 170. The conversion efficiency determination module 220 is configured to determine the second conversion efficiency based on the fifth $NO_x$ value obtained from the first $NO_x$ sensor 117 and the sixth $NO_x$ value obtained from the second $NO_x$ sensor 170.

The conversion efficiency comparison module 225 is configured to compare the first conversion efficiency to the first conversion efficiency threshold. If the first conversion efficiency is less than the first conversion efficiency threshold, this can indicate that the first catalyst member 165 is degraded. If the first conversion efficiency is greater than or equal to the first conversion efficiency threshold, this can indicate that the first catalyst member 165 is not degraded. The conversion efficiency comparison module 225 is configured to compare the second conversion efficiency to the second conversion efficiency threshold. If the second conversion efficiency is less than the second conversion efficiency threshold, this can indicate that the second catalyst member 167 is degraded. If the second conversion efficiency is greater than or equal to the second conversion efficiency threshold, this can indicate that the second catalyst member 167 is not degraded.

The first conversion efficiency threshold can be in a range of 45% to 85%. For example, the first conversion efficiency threshold can be greater than 45%. The second conversion efficiency threshold can be in a range of 45% to 85%. For example, the second conversion efficiency threshold can be greater than 45% The first conversion efficiency threshold can be the same as or different from the second conversion efficiency threshold. For example, the first conversion efficiency can be different from the second conversion efficiency if the first catalyst member 165 is different from the second catalyst member 167. The first conversion efficiency can be the same as the second conversion efficiency if the first catalyst member 165 is the same as the second catalyst member 167.

The conversion efficiency comparison module 225 is configured to compare the overall conversion efficiency to the overall conversion efficiency threshold. The instructions can cause the at least one controller 163 to operate in a regeneration mode associated with regeneration of the first catalyst member 165 and the second catalyst member 167 responsive to determining that the overall conversion efficiency is less than the overall conversion efficiency threshold.

The indication module 230 can provide an indication responsive to the determination that at least one of the first conversion efficiency is less than the first conversion efficiency threshold or the second conversion efficiency is less than the second conversion efficiency threshold. For example, if the first conversion efficiency is less than the first conversion efficiency threshold, the indication module 230 can provide an indication that the first catalyst member 165 is degraded. If the first conversion efficiency is less than the first conversion efficiency threshold, the indication module 230 can provide an indication that the first leg 160 is underperforming. If the second conversion efficiency is less than the second conversion efficiency threshold, the indication module 230 can provide an indication that the second catalyst member 167 is degraded. If the second conversion efficiency is less than the second conversion efficiency threshold, the indication module 230 can provide an indication that the second leg 162 is underperforming. The indication can include a status message indicating that the first leg 160 and/or the second leg 162 are underperforming.

The indication module 230 can provide an indication that the first leg 160 is underperforming responsive to the determination that the first conversion efficiency is less than the first conversion efficiency threshold. The indication that the first leg 160 is underperforming can indicate that the one or more catalyst members in the first leg 160 are degraded. The indication module 230 can provide an indication that the second leg 162 is underperforming responsive to the determination that the second conversion efficiency is less than the second conversion efficiency threshold. The indication that the second leg 162 is underperforming can indicate that the one or more catalyst members in the second leg 162 are degraded.

Figure 3:
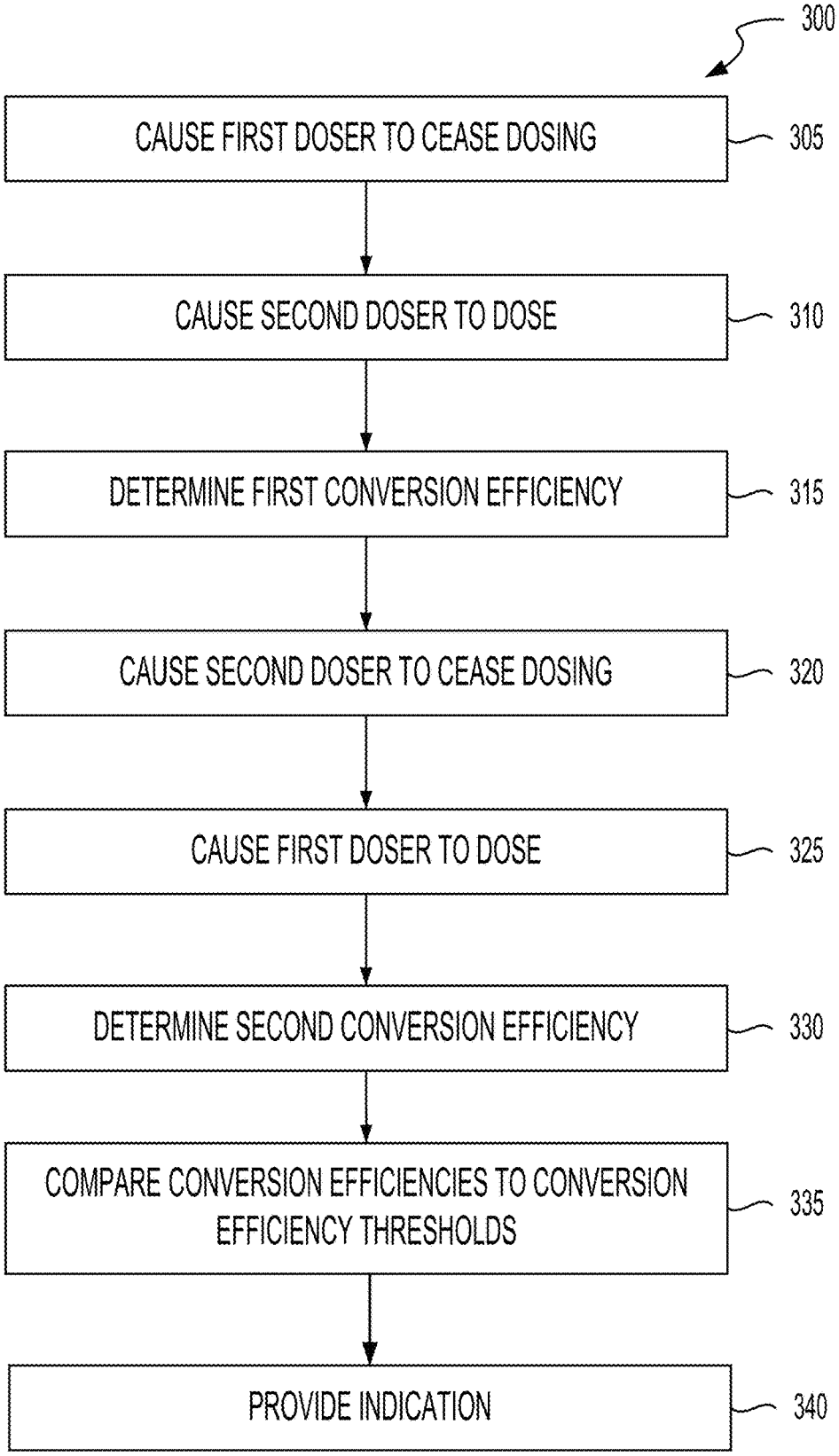
FIG. 3 is a flow chart illustrating a method to detect catalyst member degradation, according to an example embodiment.

FIG. 3 is a flow chart illustrating a method 300 to detect degradation of at least one of the first catalyst member 165 or the second catalyst member 167. The method 300 can include isolating which of the legs is leading to the low overall conversion efficiency by disabling injection of reductant in one of the legs and measuring the conversion efficiency in the other leg, and then performing the same protocol and switching the legs. The method 300 can be implemented by any of various systems and devices described herein, including but not limited to the aftertreatment system 100 and/or the at least one controller 163 (e.g., processor) described with reference to FIGS. 1 and 2. The method 300 can be implemented in any of various modalities, including but not limited to real-time techniques in which one or more aspects of the method 300 are executed responsive to real-time sensor data detected regarding $NO_x$ concentration.

The method 300 includes causing the first doser 155 to cease dosing (BLOCK 305). The method 300 includes causing the second doser 157 to dose (BLOCK 310). The method 300 includes determining a first conversion efficiency (BLOCK 315). The method 300 includes causing the second doser 157 to cease dosing (BLOCK 320). The method 300 includes causing the first doser 155 to dose (BLOCK 325). The method 300 includes determining a second conversion efficiency (BLOCK 330). The method 300 includes comparing conversion efficiencies to conversion efficiency thresholds (BLOCK 335). The method 300 includes providing an indication (BLOCK 340).

Referring to FIG. 3 in further detail, the method 300 includes causing the first doser 155 to cease dosing (BLOCK 305). The at least one controller 163 causes the first doser 155 to cease dosing. The first doser 155 ceases dosing a first reductant portion of a reductant to a first exhaust portion of exhaust (e.g., exhaust gas) upstream of the first catalyst member 165 disposed in the first leg 160 of the SCR system 150. The first doser 155 can be controlled to cease injection of reductant. The first doser 155 can be controlled to cease dosing of the first reductant portion.

The method 300 includes causing the second doser 157 to dose (BLOCK 310). The at least one controller 163 causes the second doser 157 to dose. The second doser 157 doses a second reductant portion of the reductant to a second exhaust portion of the exhaust upstream of the second catalyst member 167 disposed in the second leg 162 of the SCR system 150. The second doser 157 doses while the first doser 155 ceases dosing. The second doser 157 can be active when it doses the second reductant portion of the reductant. The second doser 157 can be dosing reductant while the first doser 155 is not dosing reductant. The second doser 157 can be controlled to cause injection of the second reductant portion.

The method 300 includes determining (e.g., calculating) a first conversion efficiency (BLOCK 315). The at least one controller 163 determines a first conversion efficiency of the first leg. For example, the at least one controller 163 determines the first conversion efficiency of the first leg 160 while the first doser 155 is not dosing the first reductant portion and the second doser 157 is dosing the second reductant portion. The first conversion efficiency includes the efficiency of converting $NO_x$ compounds to non-$NO_x$ emissions in the first leg 160. The at least one controller 163 can determine the first conversion efficiency of the first leg 160 based on data collected while the first doser 155 is not dosing the first reductant portion and the second doser 157 is dosing the second reductant portion.

The method 300 includes causing the second doser 157 to cease dosing (BLOCK 320). The at least one controller 163 causes the second doser 157 to cease dosing. The second doser 157 ceases dosing the second reductant portion of the reductant to the second exhaust portion of the exhaust upstream of the second catalyst member 167 disposed in the second leg 162 of the SCR system 150. The second doser 157 can be controlled to cease injection of reductant. The second doser 157 can be controlled to cease dosing of the second reductant portion.

The method 300 includes causing the first doser 155 to dose (BLOCK 325). The at least one controller 163 causes the first doser 155 to dose. The first doser 155 doses the first reductant portion of the reductant to the first exhaust portion of the exhaust upstream of the first catalyst member 165 disposed in the first leg 160 of the SCR system 150. The first doser 155 doses while the second doser 157 ceases dosing. The first doser 155 can be dosing reductant while the second doser 157 is not dosing reductant. The first doser 155 can be controlled to cause injection of the first reductant portion.

The method 300 includes determining (e.g., calculating) a second conversion efficiency (BLOCK 330). The at least one controller 163 determines a second conversion efficiency of the second leg 162. For example, the at least one controller 163 can determine the second conversion efficiency of the second leg 162 while the second doser 157 is not dosing the second reductant portion and the first doser 155 is dosing the first reductant portion. The second conversion efficiency can include the efficiency of converting $NO_x$ compounds to non-$NO_x$ emissions in the second leg 162. The at least one controller 163 can determine the second conversion efficiency of the second leg 162 based on data collected while the second doser 157 is not dosing the second reductant portion and the first doser 155 is dosing the first reductant portion.

The method 300 includes comparing conversion efficiencies to conversion efficiency thresholds (BLOCK 335). For example, the method 300 includes comparing the first conversion efficiency to a first conversion efficiency threshold. The at least one controller 163 can compare the first conversion efficiency to the first conversion efficiency threshold. The first conversion efficiency threshold can include the threshold at which at the first catalyst member 165 is considered degraded and/or needs to be replaced.

The method can include comparing the second conversion efficiency to a second conversion efficiency threshold. For example, the method 300 can include comparing the second conversion efficiency to a second conversion efficiency threshold. The at least one controller 163 can compare the second conversion efficiency to the second conversion efficiency threshold. The second conversion efficiency threshold can include the threshold at which at the second catalyst member 167 is considered degraded and/or needs to be replaced.

The method 300 includes providing an indication (BLOCK 340). The at least one controller 163 can provide the indication. The at least one controller 163 can provide the indication responsive to a determination that at least one of the first conversion efficiency is less than the first conversion efficiency threshold or the second conversion efficiency is less than the second conversion efficiency threshold.

Before causing the first doser 155 to cease dosing the first reductant portion and before causing the second doser 157 to cease dosing the second reductant portion, the method 300 can include determining, by the at least one controller 163, an overall conversion efficiency. The overall conversion efficiency can be determined based on a first $NO_x$ value obtained from a first $NO_x$ sensor 117 disposed upstream of the first doser 155 and the second doser 157. The overall conversion efficiency can be determined based a second $NO_x$ value obtained from the second $NO_x$ sensor 170 disposed downstream of the first leg 160 and the second leg 162. The overall conversion efficiency can be determined responsive to satisfaction of one or more enabling conditions.

The method 300 can include determining that the first leg 160 is underperforming responsive to the determination that the first conversion efficiency is less than the first conversion efficiency threshold. The at least one controller 163 can determine that the first leg 160 is underperforming responsive to the determination that the first conversion efficiency is less than the first conversion efficiency threshold. If the first leg 160 is underperforming, this can indicate that the first catalyst member 165 is degraded.

The method 300 can include determining that the second leg 162 is underperforming responsive to the determination that the second conversion efficiency is less than the second conversion efficiency threshold. The at least one controller 163 can determine that the second leg 162 is underperforming responsive to the determination that the second conversion efficiency is less than the second conversion efficiency threshold. If the second leg 162 is underperforming, this can indicate that the second catalyst member 167 is degraded.

The first $NO_x$ sensor 117 can be disposed upstream of the first leg 160 and the second leg 162. The second $NO_x$ sensor 170 can be disposed downstream of the first leg 160 and the second leg 162. The first leg 160 and the second leg 162 can be free of any $NO_x$ sensors. The method 300 can include receiving a first signal from the first $NO_x$ sensor 117 disposed upstream of the first leg 160 and the second leg 162. The method 300 can include receiving a second signal from the second $NO_x$ sensor 170 disposed downstream of the first leg 160 and the second leg 162. The method 300 can include determining a first $NO_x$ value based on the first signal. The method 300 can include determining a second $NO_x$ value based on the second signal. The method 300 can include providing the indication that at least one of the first conversion efficiency is less than the first conversion efficiency threshold or the second conversion efficiency is less than the second conversion efficiency threshold based on the first $NO_x$ value and the second $NO_x$ value.

Figure 4:
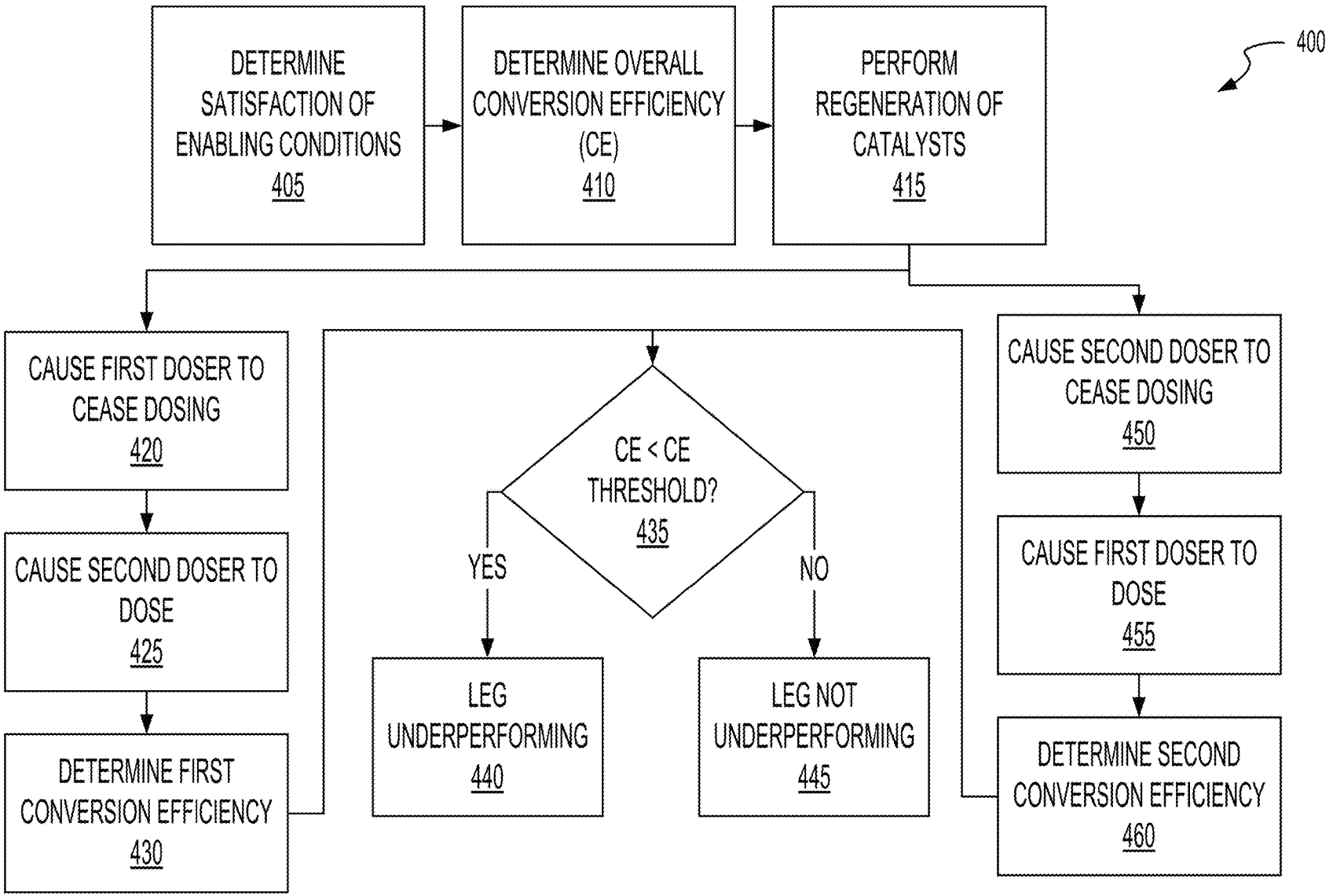
FIG. 4 is a flow chart illustrating a method to detect catalyst member degradation, according to an example embodiment.

FIG. 4 is a flow chart illustrating a method 400 to detect catalyst degradation of at least one of the first catalyst member 165 or the second catalyst member 167. The method 400 can be implemented by any of various systems and devices described herein, including but not limited to the aftertreatment system 100 and/or the at least one controller 163 (e.g., processor) described with reference to FIGS. 1 and 2. The method 400 can be implemented in any of various modalities, including but not limited to real-time techniques in which one or more aspects of the method 400 are executed responsive to real-time sensor data detected regarding $NO_x$ concentration.

The method 400 includes determining satisfaction of enabling conditions (BLOCK 405). The method 400 includes determining an overall conversion efficiency (BLOCK 410). The method 400 includes performing a regeneration of catalyst members (BLOCK 415). The method 400 includes causing the first doser 155 to cease dosing (BLOCK 420). The method 400 includes causing the second doser 157 to dose (BLOCK 425). The method 400 includes determining a first conversion efficiency (BLOCK 430). The method 400 includes determining if the conversion efficiency is less than the conversion efficiency threshold (BLOCK 435). The method 400 includes determining that the leg is underperforming (BLOCK 440) or that the leg is not underperforming (BLOCK 445). The method 400 includes causing the second doser 157 to cease dosing (BLOCK 450). The method 400 includes causing the first doser 155 to dose (BLOCK 455). The method 400 includes determining a second conversion efficiency (BLOCK 460).

Referring to FIG. 4 in further detail, the method 400 includes determining satisfaction of one or more enabling conditions (BLOCK 405). The enabling conditions can include whether a temperature of the SCR system 150 is greater than a temperature threshold. The enabling conditions can include whether a flow rate of the SCR system 150 is greater than a flow rate threshold. The enabling conditions can include whether a urea concentration of the SCR system 150 is greater than a urea concentration threshold. Satisfaction of one or more enabling conditions can include the temperature of the SCR system 150 being greater than the temperature threshold. Satisfaction of one or more enabling conditions can include the flow rate of the SCR system 150 being greater than the flow rate threshold. Satisfaction of one or more enabling conditions can include the urea concentration of the SCR system 150 being greater than a urea concentration threshold.

The method 400 includes determining an overall conversion efficiency (BLOCK 410). The overall conversion efficiency includes the conversion efficiency of the overall aftertreatment system. For example, the overall conversion efficiency can include the conversion efficiency of the catalyst members disposed in the aftertreatment system. The catalyst members can include the first catalyst member 165 disposed in the first leg 160 and the second catalyst member 167 disposed in the second leg 162. The overall conversion efficiency can include the conversion efficiency of the one or more catalyst members in the first leg 160 and the one or more catalyst members in the second leg 162.

The method 400 includes performing a regeneration of catalyst members (BLOCK 415). Regeneration of catalyst members includes clearing out deposits in the first catalyst member. Regeneration of catalysts can include clearing out deposits in the second catalyst member 167. Regeneration of the catalyst members can rule out any deposit-related issues. For example, deposits (rather than one or more degraded catalyst members) may be causing a low overall conversion efficiency. Performing the regeneration of the catalyst members can eliminate deposits as a cause of the low overall conversion efficiency.

The method 400 includes causing the first doser 155 to cease dosing (BLOCK 420). The first doser 155 can cease dosing a first reductant portion of a reductant to a first exhaust portion of exhaust (e.g., exhaust gas) upstream of a first catalyst member 165 disposed in the first leg 160 of the SCR system 150. The first doser 155 can be inactive when it ceases dosing the first reductant portion of the reductant.

The method 400 includes causing the second doser 157 to dose (BLOCK 425). The second doser 157 can dose a second reductant portion of the reductant to a second exhaust portion of the exhaust upstream of the second catalyst member 167 disposed in the second leg 162 of the SCR system 150. The second doser 157 can dose while the first doser 155 ceases dosing. The second doser 157 can be active when it doses the second reductant portion of the reductant. The second doser 157 can be active while the first doser 155 is inactive.

The method 400 includes determining (e.g., calculating) a first conversion efficiency (BLOCK 430). For example, the method 400 includes determining the first conversion efficiency of the first leg 160 while the first doser 155 is not dosing the first reductant portion and the second doser 157 is dosing the second reductant portion. The first conversion efficiency can include the efficiency of converting $NO_x$ compounds to non-$NO_x$ emissions in the first leg 160. The at least one controller 163 can determine the first conversion efficiency of the first leg 160 based on data collected while the first doser 155 is not dosing the first reductant portion and the second doser 157 is dosing the second reductant portion.

The method 400 includes determining if the conversion efficiency is less than the conversion efficiency threshold (BLOCK 435). For example, the method 400 includes determining if the first conversion efficiency is less than the first conversion efficiency threshold. The first conversion efficiency threshold can include the threshold at which at the first catalyst member 165 is considered degraded and/or needs to be replaced.

The method 400 includes determining that the leg is underperforming (BLOCK 440) or that the leg is not underperforming (BLOCK 445). For example, the method 400 includes determining that the first leg 160 is underperforming or that the first leg 160 is not underperforming. If the first conversion efficiency is less than the first conversion efficiency threshold, the method 400 can determine that the first leg 160 is underperforming. If the first conversion efficiency is greater than or equal to the first conversion efficiency threshold, the method 400 can determine that the first leg 160 not underperforming. If the first leg 160 is underperforming, this can indicate that the first catalyst member 165 is degraded. If the first leg 160 is not underperforming, this can indicate that the first catalyst member 165 is not degraded.

The method 400 includes causing the second doser 157 to cease dosing (BLOCK 450). The second doser 157 can cease dosing the second reductant portion of the reductant to the second exhaust portion of the exhaust upstream of the second catalyst member 167 disposed in the second leg 162 of the SCR system 150. The second doser 157 can be inactive when it ceases dosing the second reductant portion of the reductant.

The method 400 includes causing the first doser 155 to dose (BLOCK 455). The first doser 155 can dose the first reductant portion of the reductant to the first exhaust portion of the exhaust upstream of the first catalyst member 165 disposed in the first leg 160 of the SCR system 150. The first doser 155 can dose while the second doser 157 ceases dosing. The first doser 155 can be active when it doses the first reductant portion of the reductant. The first doser 155 can be active while the second doser 157 is inactive.

The method 400 includes determining (e.g., calculating) a second conversion efficiency (BLOCK 460). For example, the method 400 includes determining the second conversion efficiency of the second leg 162 while the second doser 157 is not dosing the second reductant portion and the first doser 155 is dosing the first reductant portion. The second conversion efficiency can include the efficiency of converting $NO_x$ compounds to non-$NO_x$ emissions in the second leg 162. The at least one controller 163 can determine the second conversion efficiency of the second leg 162 based on data collected while the second doser 157 is not dosing the second reductant portion and the first doser 155 is dosing the first reductant portion.

The method 400 includes determining if the conversion efficiency is less than the conversion efficiency threshold (BLOCK 435). For example, the method 400 includes determining if the second conversion efficiency is less than the second conversion efficiency threshold. The second conversion efficiency threshold can include the threshold at which at the second catalyst member 167 is considered degraded and/or needs to be replaced.

The method 400 includes determining that the leg is underperforming (BLOCK 440) or that the leg is not underperforming (BLOCK 445). For example, the method 400 includes determining that the second leg 162 is underperforming or that the second leg 162 is not underperforming. If the second conversion efficiency is less than the second conversion efficiency threshold, the method 400 can determine that the second leg 162 is underperforming. If the second conversion efficiency is greater than or equal to the second conversion efficiency threshold, the method 400 can determine that the second leg 162 not underperforming. If the second leg 162 is underperforming, this can indicate that the second catalyst member 167 is degraded. If the second leg 162 is no underperforming, this can indicate that the second catalyst member 167 is not degraded.

IV. Configuration of Example Embodiments

Having now described some illustrative implementations, it is apparent that the foregoing is illustrative and not limiting, having been presented by way of example. In particular, although many of the examples presented herein involve specific combinations of method acts or system elements, those acts and those elements may be combined in other ways to accomplish the same objectives. Acts, elements and features discussed in connection with one implementation are not intended to be excluded from a similar role in other implementation or implementations.

The phraseology and terminology used herein is for the purpose of description and should not be regarded as limiting. The use of "including," "comprising," "having," "containing," "involving," and variations thereof herein, is meant to encompass the items listed thereafter, equivalents thereof, and additional items, as well as alternate implementations consisting of the items listed thereafter exclusively. In one implementation, the systems and methods described herein consist of one, each combination of more than one, or all of the described elements, acts, or components.

Embodiments of the subject matter and the operations described in this specification can be implemented in digital electronic circuitry, or in computer software, firmware, or hardware, including the structures disclosed in this specification and their structural equivalents, or in combinations of one or more of them. The subject matter described in this specification can be implemented as one or more computer programs, e.g., one or more circuits of computer program instructions, encoded on one or more computer storage media for execution by, or to control the operation of, data processing apparatus. Alternatively or in addition, the program instructions can be encoded on an artificially generated propagated signal, e.g., a machine-generated electrical, optical, or electromagnetic signal that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially generated propagated signal. The computer storage medium can also be, or be included in, one or more separate components or media (e.g., multiple CDs, disks, or other storage devices).

The operations described in this specification can be performed by a data processing apparatus on data stored on one or more computer-readable storage devices or received from other sources. The term "data processing apparatus" or "computing device" encompasses various apparatuses, devices, and machines for processing data, including by way of example a programmable processor, a computer, a system on a chip, or multiple ones, or combinations of the foregoing. The apparatus can include special purpose logic circuitry, e.g., an FPGA (field programmable gate array) or an ASIC (application specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a standalone program or as a circuit, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more circuits, subprograms, or portions of code). A computer program can be deployed to be executed on one computer or on multiple computers that are located at one site or distributed across multiple sites and interconnected by a communication network.

Processors suitable for the execution of a computer program include, by way of example, microprocessors, and any one or more processors of a digital computer. A processor can receive instructions and data from a read only memory or a random-access memory or both. The elements of a computer are a processor for performing actions in accordance with instructions and one or more memory devices for storing instructions and data. A computer can include, or be operatively coupled to receive data from or transfer data to, or both, one or more mass storage devices for storing data, e.g., magnetic, magneto optical disks, or optical disks. A computer need not have such devices. Moreover, a computer can be embedded in another device, e.g., a personal digital assistant (PDA), a Global Positioning System (GPS) receiver, or a portable storage device (e.g., a universal serial bus (USB) flash drive), to name just a few. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, implementations of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

The implementations described herein can be implemented in any of numerous ways including, for example, using hardware, software or a combination thereof. When implemented in software, the software code can be executed on any suitable processor or collection of processors, whether provided in a single computer or distributed among multiple computers.

Also, a computer may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

A computer employed to implement at least a portion of the functionality described herein may comprise a memory, one or more processing units (also referred to herein simply as "processors"), one or more communication interfaces, one or more display units, and one or more user input devices. The memory may comprise any computer-readable media, and may store computer instructions (also referred to herein as "processor-executable instructions") for implementing the various functionalities described herein. The processing unit(s) may be used to execute the instructions. The communication interface(s) may be coupled to a wired or wireless network, bus, or other communication means and may therefore allow the computer to transmit communications to or receive communications from other devices. The display unit(s) may be provided, for example, to allow a user to view various information in connection with execution of the instructions. The user input device(s) may be provided, for example, to allow the user to make manual adjustments, make selections, enter data or various other information, or interact in any of a variety of manners with the processor during execution of the instructions.

The various methods or processes outlined herein may be coded as software that is executable on one or more processors that employ any one of a variety of operating systems or platforms. Additionally, such software may be written using any of a number of suitable programming languages or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the solution discussed above. The computer readable medium or media can be transportable, such that the program or programs stored thereon can be loaded onto one or more different computers or other processors to implement various aspects of the present solution as discussed above.

The methods described herein, or operations thereof, may be implemented in machine-readable medium for execution by various types of processors of the controller. A circuit of executable code may, for instance, comprise one or more physical or logical blocks of computer instructions, which may, for instance, be organized as an object, procedure, or function. Nevertheless, the executables of an identified circuit need not be physically located together, but may comprise disparate instructions stored in different locations which, when joined logically together, comprise the circuit and achieve the stated purpose for the circuit. Indeed, a circuit of computer readable program code may be a single instruction, or many instructions, and may even be distributed over several different code segments, among different programs, and across several memory devices. Similarly, operational data may be identified and illustrated herein within circuits, and may be embodied in any suitable form and organized within any suitable type of data structure. The operational data may be collected as a single data set, or may be distributed over different locations including over different storage devices, and may exist, at least partially, merely as electronic signals on a system or network.

The computer readable medium (also referred to herein as machine-readable media or machine-readable content) may be a tangible computer readable storage medium storing the computer readable program code. The computer readable storage medium may be, for example, but not limited to, an electronic, magnetic, optical, electromagnetic, infrared, holographic, micromechanical, or semiconductor system, apparatus, or device, or any suitable combination of the foregoing. As alluded to above, examples of the computer readable storage medium may include but are not limited to a portable computer diskette, a hard disk, a random access memory (RAM), a read-only memory (ROM), an erasable programmable read-only memory (EPROM or Flash memory), a portable compact disc read-only memory (CD-ROM), a digital versatile disc (DVD), an optical storage device, a magnetic storage device, a holographic storage medium, a micromechanical storage device, or any suitable combination of the foregoing. In the context of this document, a computer readable storage medium may be any tangible medium that can contain, and/or store computer readable program code for use by and/or in connection with an instruction execution system, apparatus, or device.

The computer readable medium may also be a computer readable signal medium. A computer readable signal medium may include a propagated data signal with computer readable program code embodied therein, for example, in baseband or as part of a carrier wave. Such a propagated signal may take any of a variety of forms, including, but not limited to, electrical, electro-magnetic, magnetic, optical, or any suitable combination thereof. A computer readable signal medium may be any computer readable medium that is not a computer readable storage medium and that can communicate, propagate, or transport computer readable program code for use by or in connection with an instruction execution system, apparatus, or device. As also alluded to above, computer readable program code embodied on a computer readable signal medium may be transmitted using any appropriate medium, including but not limited to wireless, wireline, optical fiber cable, Radio Frequency (RF), or the like, or any suitable combination of the foregoing. In one embodiment, the computer readable medium may comprise a combination of one or more computer readable storage mediums and one or more computer readable signal mediums. For example, computer readable program code may be both propagated as an electro-magnetic signal through a fiber optic cable for execution by a processor and stored on RAM storage device for execution by the processor.

Computer readable program code for carrying out operations for aspects of the present disclosure may be written in any combination of one or more programming languages, including an object-oriented programming language such as Java, Smalltalk, C++ or the like and conventional procedural programming languages, such as the "C" programming language or similar programming languages. The computer readable program code may execute entirely on a local computer (such as via the at least one controller 163 of FIG. 1), partly on the local computer, as a stand-alone computer-readable package, partly on the local computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The program code may also be stored in a computer readable medium that can direct a computer, other programmable data processing apparatus, or other devices to function in a particular manner, such that the instructions stored in the computer readable medium produce an article of manufacture including instructions which implement the function/act specified in the schematic flowchart diagrams and/or schematic block diagrams block or blocks.

It should be noted that the term "example" as used herein to describe various embodiments is intended to indicate that such embodiments are possible examples, representations, and/or illustrations of possible embodiments (and such term is not intended to connote that such embodiments are necessarily extraordinary or superlative examples).

As used herein, the term "about," or similar terms, generally mean plus or minus 10% of the stated value. For example, about 0.5 would include 0.45 and 0.55, about 10 would include 9 to 11, about 1000 would include 900 to 1100.

The term "coupled" and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

As utilized herein, the terms "substantially," "generally," "approximately," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the appended claims.

Any references to implementations or elements or acts of the systems and methods herein referred to in the singular may also embrace implementations including a plurality of these elements, and any references in plural to any implementation or element or act herein may also embrace implementations including only a single element. References in the singular or plural form are not intended to limit the presently disclosed systems or methods, their components, acts, or elements to single or plural configurations. References to any act or element being based on any information, act or element may include implementations where the act or element is based at least in part on any information, act, or element.

Any implementation disclosed herein may be combined with any other implementation or embodiment, and references to "an implementation," "some implementations," "one implementation" or the like are not necessarily mutually exclusive and are intended to indicate that a particular feature, structure, or characteristic described in connection with the implementation may be included in at least one implementation or embodiment. Such terms as used herein are not necessarily all referring to the same implementation. Any implementation may be combined with any other implementation, inclusively or exclusively, in any manner consistent with the aspects and implementations disclosed herein.

Also, the term "or" is used, in the context of a list of elements, in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

Additionally, the use of ranges of values (e.g., W1 to W2, etc.) herein are inclusive of their maximum values and minimum values (e.g., W1 to W2 includes W1 and includes W2, etc.), unless otherwise indicated. Furthermore, a range of values (e.g., W1 to W2, etc.) does not necessarily require the inclusion of intermediate values within the range of values (e.g., W1 to W2 can include only W1 and W2, etc.), unless otherwise indicated.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements; values of parameters, mounting arrangements; use of materials, colors, orientations, etc.) without materially departing from the novel teachings and advantages of the subject matter described herein. Additionally, it should be understood that features from one embodiment disclosed herein may be combined with features of other embodiments disclosed herein as one of ordinary skill in the art would understand. Other substitutions, modifications, changes, and omissions may also be made in the design, operating conditions, and arrangement of the various exemplary embodiments without departing from the scope of the present embodiments.

While this specification contains many specific implementation details, these should not be construed as limitations on the scope of any embodiments or of what may be claimed, but rather as descriptions of features specific to particular implementations of particular embodiments. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

What is claimed is:

1. A non-transitory computer-readable media having computer-readable instructions stored thereon that, when executed by at least one controller, cause the at least one controller to:

cause a first doser to cease dosing a first reductant portion of a reductant to a first exhaust portion of exhaust upstream of a first catalyst member disposed in a first leg of a selective catalytic reduction (SCR) system;

cause a second doser to dose a second reductant portion of the reductant to a second exhaust portion of the exhaust upstream of a second catalyst member disposed in a second leg of the SCR system;

determine a first conversion efficiency of the first leg while the first doser is not dosing the first reductant portion and the second doser is dosing the second reductant portion;

cause the second doser to cease dosing the second reductant portion to the second exhaust portion;

cause the first doser to dose the first reductant portion to the first exhaust portion;

determine a second conversion efficiency of the second leg while the first doser is dosing the first reductant portion and the second doser is not dosing the second reductant portion;

compare the first conversion efficiency to a first conversion efficiency threshold;

compare the second conversion efficiency to a second conversion efficiency threshold; and provide an indication responsive to a determination that at least one of the first conversion efficiency is less than the first conversion efficiency threshold or the second conversion efficiency is less than the second conversion efficiency threshold.

2. The non-transitory computer-readable media of claim 1, wherein the computer-readable instructions, when executed by the at least one controller, further cause the at least one controller to, responsive to satisfaction of one or more enabling conditions, determine an overall conversion efficiency based on a first $NO_x$ value obtained from a first $NO_x$ sensor disposed upstream of the first doser and the second doser, and a second $NO_x$ value obtained from a second $NO_x$ sensor disposed downstream of the first leg and the second leg.

3. The non-transitory computer-readable media of claim 2, wherein the computer-readable instructions, when executed by the at least one controller, further cause the at least one controller to:

determine the first conversion efficiency based on a third $NO_x$ value obtained from the first $NO_x$ sensor and a fourth $NO_x$ value obtained from the second $NO_x$ sensor; and determine the second conversion efficiency based on a fifth $NO_x$ value obtained from the first $NO_x$ sensor and a sixth $NO_x$ value obtained from the second $NO_x$ sensor.

4. The non-transitory computer-readable media of claim 2, wherein the computer-readable instructions, when executed by the at least one controller, further cause the at least one controller to:

compare the overall conversion efficiency to an overall conversion efficiency threshold; and cause an engine system to operate in a regeneration mode associated with regeneration of the first catalyst member and the second catalyst member responsive to determining that the overall conversion efficiency is less than the overall conversion efficiency threshold.

5. The non-transitory computer-readable media of claim 2, wherein the computer-readable instructions, when executed by the at least one controller, further cause the at least one controller to determine the overall conversion efficiency responsive to determining that a temperature of the SCR system is greater than a temperature threshold.

6. The non-transitory computer-readable media of claim 2, wherein the computer-readable instructions, when executed by the at least one controller, further cause the at least one controller to determine the overall conversion efficiency responsive to determining that a flow rate of the SCR system is greater than a flow rate threshold.

7. The non-transitory computer-readable media of claim 2, wherein the computer-readable instructions, when executed by the at least one controller, further cause the at least one controller to determine the overall conversion efficiency responsive to determining that a urea concentration of the SCR system is greater than a urea concentration threshold.

8. The non-transitory computer-readable media of claim 1, wherein the computer-readable instructions, when executed by the at least one controller, further cause the at least one controller to:

determine that the first leg is underperforming responsive to the determination that the first conversion efficiency is less than the first conversion efficiency threshold; and determine that the second leg is underperforming responsive to the determination that the second conversion efficiency is less than the second conversion efficiency threshold.

9. An aftertreatment system comprising:

the non-transitory computer-readable media of claim 1;

the at least one controller; and a first $NO_x$ sensor disposed upstream of the first doser and the second doser; and a second $NO_x$ sensor disposed downstream of the first leg and the second leg;

wherein the computer-readable instructions, when executed by the at least one controller, further cause the at least one controller to:

receive a first signal from the first $NO_x$ sensor and a second signal from the second $NO_x$ sensor, determine a first $NO_x$ value based on the first signal, determine a second $NO_x$ value based on the second signal, and provide the indication that at least one of the first conversion efficiency is less than the first conversion efficiency threshold or the second conversion efficiency is less than the second conversion efficiency threshold based on the first $NO_x$ value and the second $NO_x$ value.

10. The aftertreatment system of claim 9, wherein the first leg and the second leg are free of any $NO_x$ sensors.

11. The aftertreatment system of claim 9, wherein the computer-readable instructions, when executed by the at least one controller, further cause the at least one controller to, responsive to satisfaction of one or more enabling conditions, determine an overall conversion efficiency based on the first $NO_x$ value and the second $NO_x$ value.

12. The aftertreatment system of claim 11, wherein the computer-readable instructions, when executed by the at least one controller, further cause the at least one controller to cause the aftertreatment system to operate in a regeneration mode associated with regeneration of the first catalyst member and the second catalyst member responsive to determining that the overall conversion efficiency is less than an overall conversion efficiency threshold.

13. The aftertreatment system of claim 9, wherein the computer-readable instructions, when executed by the at least one controller, further cause the at least one controller to:

determine that the first leg is underperforming responsive to the determination that the first conversion efficiency is less than the first conversion efficiency threshold; and determine that the second leg is underperforming responsive to the determination that the second conversion efficiency is less than the second conversion efficiency threshold.

14. A method comprising:

causing, by at least one controller, a first doser to cease dosing a first reductant portion of a reductant to a first exhaust portion of exhaust upstream of a first catalyst member disposed in a first leg of a selective catalytic reduction (SCR) system;

causing, by the at least one controller, a second doser to dose a second reductant portion of the reductant to a second exhaust portion of the exhaust upstream of a second catalyst member disposed in a second leg of the SCR system;

determining, by the at least one controller, a first conversion efficiency of the first leg while the first doser is not dosing the first reductant portion and the second doser is dosing the second reductant portion;

causing, by the at least one controller, the second doser to cease dosing the second reductant portion to the second exhaust portion;

causing, by the at least one controller, the first doser to dose the first reductant portion to the first exhaust portion;

determining, by the at least one controller, a second conversion efficiency of the second leg while the first doser is dosing the first reductant portion and the second doser is not dosing the second reductant portion;

comparing, by the at least one controller, the first conversion efficiency to a first conversion efficiency threshold;

comparing, by the at least one controller, the second conversion efficiency to a second conversion efficiency threshold; and providing, by the at least one controller, an indication responsive to a determination that at least one of the first conversion efficiency is less than the first conversion efficiency threshold or the second conversion efficiency is less than the second conversion efficiency threshold.

15. The method of claim 14, further comprising:

before causing the first doser to cease dosing the first reductant portion and before causing the second doser to cease dosing the second reductant portion, determining, by the at least one controller, an overall conversion efficiency based on a first $NO_x$ value obtained from a first $NO_x$ sensor disposed upstream of the first doser and the second doser and a second $NO_x$ value obtained from a second $NO_x$ sensor disposed downstream of the first leg and the second leg responsive to satisfaction of one or more enabling conditions.

16. The method of claim 15, further comprising:

performing, by the at least one controller, regeneration of the first catalyst member and the second catalyst member responsive to a determination that the overall conversion efficiency is less than an overall conversion efficiency threshold.

17. The method of claim 14, further comprising:

determining, by the at least one controller, that the first leg is underperforming responsive to the determination that the first conversion efficiency is less than the first conversion efficiency threshold.

18. The method of claim 14, further comprising:

determining, by the at least one controller, that the second leg is underperforming responsive to the determination that the second conversion efficiency is less than the second conversion efficiency threshold.

19. The method of claim 14, wherein:

a first $NO_x$ sensor is disposed upstream of the first leg and the second leg;

a second $NO_x$ sensor is disposed downstream of the first leg and the second leg; and the first leg and the second leg are free of any $NO_x$ sensors.

20. The method of claim 14, further comprising:

receiving, by the at least one controller, a first signal from a first $NO_x$ sensor disposed upstream of the first leg and the second leg;

receiving, by the at least one controller, a second signal from a second $NO_x$ sensor disposed downstream of the first leg and the second leg;

determining, by the at least one controller, a first $NO_x$ value based on the first signal;

determining, by the at least one controller, a second $NO_x$ value based on the second signal; and providing the indication that at least one of the first conversion efficiency is less than the first conversion efficiency threshold or the second conversion efficiency is less than the second conversion efficiency threshold based on the first $NO_x$ value and the second $NO_x$ value.

* * * * *